US010156347B2

(12) United States Patent
Pontano et al.

(10) Patent No.: US 10,156,347 B2
(45) Date of Patent: Dec. 18, 2018

(54) HEADGEAR ASSEMBLY AND COMPONENTS

(71) Applicant: Industrial Revolution, Inc., Tukwila, WA (US)

(72) Inventors: Peter Pontano, Seattle, WA (US); Colin Quinn, Seattle, WA (US)

(73) Assignee: Industrial Revolution, Inc., Tukwila, WA (US)

( * ) Notice: Subject to any disclaimer, the term of this patent is extended or adjusted under 35 U.S.C. 154(b) by 0 days.

(21) Appl. No.: 15/744,941

(22) PCT Filed: Dec. 31, 2015

(86) PCT No.: PCT/US2015/068304

§ 371 (c)(1),
(2) Date: Jan. 15, 2018

(87) PCT Pub. No.: WO2017/011028

PCT Pub. Date: Jan. 19, 2017

(65) Prior Publication Data

US 2018/0209618 A1 Jul. 26, 2018

Related U.S. Application Data

(60) Provisional application No. 62/193,454, filed on Jul. 16, 2015, provisional application No. 62/193,460, filed on Jul. 16, 2015.

(51) Int. Cl.
*F21V 21/084* (2006.01)
*A42B 3/14* (2006.01)
(Continued)

(52) U.S. Cl.
CPC ..... *F21V 21/084* (2013.01); *A42B 3/145* (2013.01); *F21V 21/0816* (2013.01); *F21V 21/145* (2013.01); *F21V 33/0004* (2013.01)

(58) Field of Classification Search
CPC .. F21V 21/084; F21V 33/0004; F21V 21/145; F21V 21/0816; A42B 3/145
See application file for complete search history.

(56) References Cited

U.S. PATENT DOCUMENTS 3,645,254 A * 2/1972 Burton ..... F21L 14/00 600/249
3,745,993 A * 7/1973 Feinbloom ..... F21L 14/00 362/105

(Continued)

*Primary Examiner* — Karabi Guharay
*Assistant Examiner* — Glenn Zimmerman
(74) *Attorney, Agent, or Firm* — DWC Law Firm, P.S.; David Chen

(57) ABSTRACT

An adjustable circumference headgear assembly comprises an adjustable band component in combination with a flexible accessory mount band. The adjustable band component may be independently adjustable to provide both macro and fine fit adjustments. The flexible accessory mount band provides an accessory frame and an accessory mount, optionally including a hinge member. The accessory mount band may optionally incorporate mechanical features, such as hinged (e.g., scored) sections providing enhanced flexibility, bend and rotation relief features such as criss-crossing leg members, and the like, providing enhanced headgear flexibility and comfort.

7 Claims, 9 Drawing Sheets

(51) Int. Cl.

| | |
|---|---|
| ***F21V 21/08*** | (2006.01) |
| ***F21V 21/14*** | (2006.01) |
| ***F21V 33/00*** | (2006.01) |

(56) References Cited

U.S. PATENT DOCUMENTS

| | | | | |
|---|---|---|---|---|
| 4,797,736 | A * | 1/1989 | Kloots | F21V 21/084 348/370 |
| 5,555,569 | A * | 9/1996 | Lane | A42B 3/288 128/201.22 |
| 7,210,810 | B1 * | 5/2007 | Iversen | A61B 90/35 362/105 |
| 2009/0116225 | A1 * | 5/2009 | Feinbloom | F21L 2/00 362/105 |
| 2014/0101828 | A1 * | 4/2014 | Sugerman | A42B 3/145 2/411 |

* cited by examiner

HEADGEAR ASSEMBLY AND COMPONENTS

CROSS REFERENCE TO RELATED APPLICATION(S)

This application claims priority to U.S. Provisional Patent Application Nos. 62/193,454 and 62/193,460, both filed Jul. 16, 2015, each of which is incorporated herein by reference in its entirety.

TECHNICAL FIELD

The present disclosure relates, in one aspect, to headgear having multiple components providing an adjustable circumference strap providing a comfortable and conformable fit to an underlying surface, such as a user's head. The present disclosure, in another aspect, relates to headgear incorporating a pivotable accessory, such as a lamp. Headlamp assemblies and components are described in detail.

BACKGROUND

There are many different types of headgear that are adjustable to fit around a user's head. Baseball-type caps may be adjustable using overlapping straps having complementary hook and loop fasteners or a buckle or other types of adjustment features. Some baseball-type caps have overlapping plastic straps extending across an opening at the rear of the cap, with complementary pins and receiving holes arranged on opposing bands that may be aligned in different ways and press-fit to provide a desired cap circumference. Other types of headgear, such as helmets and masks, may incorporate opposing bands that can be adjusted relative to one another using a geared mechanism to provide larger circumference and smaller circumference adjustments.

Headlamp assemblies providing a lamp mounted on a band that can be mounted on a user's head are popular accessories for nighttime activities. Some conventional headlamp assemblies mount a lamp on an elastic band and provide fittings for shortening and lengthening the band to change the working circumference of the band and provide adjustment to different head sizes. These systems rely on the tension of the elastic to provide radial pressure on the head to hold the lamp in place. The elastic bands tend to loosen over time and rarely provide secure mounting of the lamp to the user's head as the user participates in activities. Furthermore, the larger or heavier the headlamp and the more strenuous the user's activity, the more tension is required to provide sufficient radial pressure to secure and maintain the headgear in position, often producing discomfort. Additionally, the lamp is typically provided in a hard plastic case mounted on the elastic band using a hard plastic mounting frame, which is detrimental to user comfort, particularly as the elastic band is tightened to provide a secure fit.

Headlamp assemblies typically provide a limited lamp pivoting range. Many headlamps are pivotable through a pivot range of approximately 45°, for example, with discrete stop positions at predetermined angular orientations. If a user wishes to direct the lamp's illumination in a direction outside the pivoting range of the lamp, he or she adjusts the neck or body position to achieve the desired direction of illumination. This adjustment technique is inconvenient and may produce undesirable pain and fatigue.

This disclosure is directed to providing headgear having an adjustable circumference strap providing secure, comfortable and convenient mounting and removal of the headgear to a user's head. This disclosure is furthermore directed to an improved mounting assembly for an accessory such as a lamp (or another accessory) that may be incorporated in a comfortable and adjustable band system.

BRIEF SUMMARY

Specific embodiments of an adjustable circumference headgear strap assembly are disclosed herein and are configured for supporting an accessory such as an illumination device. In many embodiments, the headgear strap assembly is configured for positioning an accessory (e.g., an illumination device) approximately in the front-center of the user's forehead, while circumferential portions of the strap assembly wrap around the user's head.

In some embodiments, the headgear assembly comprises an adjustable band component that is independently adjustable to provide both macro and fine fit adjustments. The adjustable band component, in some embodiments, comprises a pair of length adjustment straps, each of the straps having a plurality of macro adjustment interface features (such as bosses or recesses) configured to mate with complementary interface features (such as recesses or bosses) provided in association with a flexible accessory mount band. Selectable alignment and mating of complementary interface features provides macro adjustment of the strap and headgear assembly circumference.

The adjustable band component may additionally (or alternatively) incorporate a fine adjustment system. In one embodiment, described in detail below, each of the length adjustment straps has an internal cavity spaced at a distance from the macro adjustment interface features, and the internal cavities have fine-adjustment gear teeth arranged along one edge. Two length adjustment straps are aligned and overlapped (front-face to back-face) in a complementary and opposed orientation and then assembled through slots of a strap alignment component. The opposed length adjustment straps are moved symmetrically and in opposite directions with respect to one another to increase, or reduce, the combined strap length and, thus, the circumference of the headgear assembly, by means of a ratcheting mechanism and locking pawl gear that interfaces with the teeth provided on each of the length adjustment straps. In many embodiments, including embodiments illustrated and described in detail herein, a headgear assembly incorporates both macro and fine circumferential adjustment features.

In specific embodiments that are described and illustrated, a fine adjustment housing incorporates internal saw-tooth serrations and provides an internal cavity for mounting of a locking pawl component and a rotational dial providing user adjustment of the overall strap length and headgear circumference. The locking pawl includes a flexible pawl arm having a protrusion that interfaces with the internal saw-tooth teeth and, in combination with pawl interface pins provided on a rotational adjustment knob, provides a ratcheting adjustment mechanism. The ratcheting mechanism permits free rotation of the pawl gear to move the length adjustment straps and shorten or lengthen the overall strap length when the rotational dial is rotated in in clockwise or counterclockwise directions, while preventing rotation of the pawl gear in a loosening direction when the dial is not rotated, in order to stably hold the length adjustment straps in position when the locking pawl and pawl gear is stationary.

A flexible accessory mount band that coordinates with the adjustable band component may be provided, as described herein, to provide an adjustable circumference headgear assembly. In some embodiments, a conformable frame assembly comprises two end portions, each end portion providing macro fit interface features that complement the macro adjustment interface features provided on the length adjustment straps to provide step-wise circumferential fit adjustment of a headgear assembly. The conformable frame assembly may also comprise an accessory frame and accessory mount, optionally including a hinge member. The conformable frame assembly may optionally incorporate mechanical features, such as hinged (e.g., scored) sections providing enhanced flexibility, bend and rotation relief features such as and criss-crossing leg members, and the like, providing enhanced headgear assembly flexibility and comfort.

In many headgear assembly embodiments described herein, a hinge component includes a pivoting mount for an accessory, such as a headlamp, enabling rotation of the accessory around a hinge axis. Continuous, smooth rotation of the accessory may be provided throughout a relatively large pivot range (e.g., a pivot range of over 45°, over 60°, and/or over 90°, and the pivot mechanism may be provided internally or externally of an accessory housing profile.

Additional headgear assembly and circumferential strap fit assembly features are disclosed. Many of these features are directed to providing stable, secure and comfortable mounting of headgear to a user's head, regardless of the size and conformation of the user's head. Various comfort features, including materials of construction and component covers are described. The circumferential strap fit assembly provides a comfortable, flexible fit for any shape and size head, and the flexible accessory mount band provides stable mounting of an accessory and enhanced user comfort. These features are particularly important when an accessory such as a headlamp is worn during periods of active use, for extended periods of time, and during high stress situations.

All views described above illustrate example embodiments of the present disclosure. As will be appreciated by those skilled in the art upon reviewing the present disclosure, the appended drawings are not necessarily to scale, and they present simplified, schematic views of various aspects of systems and components of the present disclosure. Specific design features, including dimensions, orientations, locations and configurations of various illustrated components may be modified, for example, for use in various intended applications and environments.

DETAILED DESCRIPTION OF EXEMPLARY EMBODIMENTS

Specific embodiments of the adjustable circumference headgear strap assemblies disclosed herein are configured for supporting an accessory such as an illumination device, and for positioning and wearing around a user's head. In many embodiments, the assembly is configured for positioning the accessory (e.g., an illumination device) approximately in the front-center of the user's forehead. The accessory may generally be positioned in a substantially vertical plane against the user's forehead, with circumferential portions of the strap wrapping around the user's head, above the user's ears. It will be appreciated that adjustable circumference straps and various strap features, as disclosed herein, may be used for purposes other than headgear assemblies, and that many different types of accessories and accessory mounting systems may be used in conjunction with various adjustable circumference straps and strap features, and that the present disclosure and appended claims are not necessarily limited to the specific embodiments described below.

In the description provided herein, the term "about" means+/−20% of the indicated value or range unless otherwise indicated. The terms "a" and "an," as used herein, refer to one or more of the enumerated components or items. The use of alternative language (e.g., "or") will be understood to mean either one, both or any combination of the alternatives, unless otherwise expressly indicated. The terms "include" and "comprise" and "have" are used interchangeably and each of these terms, and variants thereof, are intended to be construed as being non-limiting.

References to "internal" surfaces and orientations in this disclosure refer to surfaces and orientations that are closer to or oriented toward a structure (e.g., a user's head) enclosed by an adjustable circumference strap assembly or contacted by flexible accessory mount band, while references to "external" surfaces and orientations refer to surfaces and orientations that are farther from or oriented away from a structure (e.g., a user's head) enclosed by an adjustable circumference strap assembly or contacted by flexible accessory mount band.

Figure 1A:
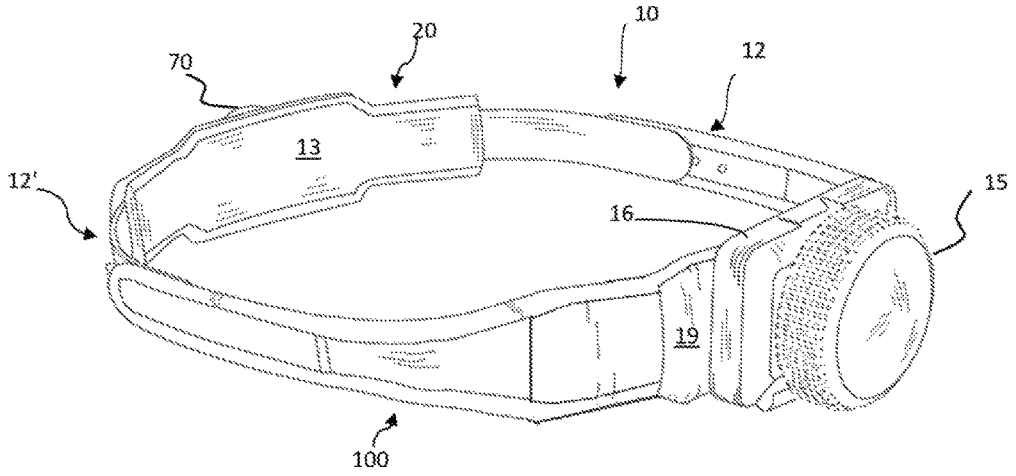
FIG. 1*a* shows a top perspective view of an embodiment of a headgear assembly as described in detail herein.
Figure 1B:
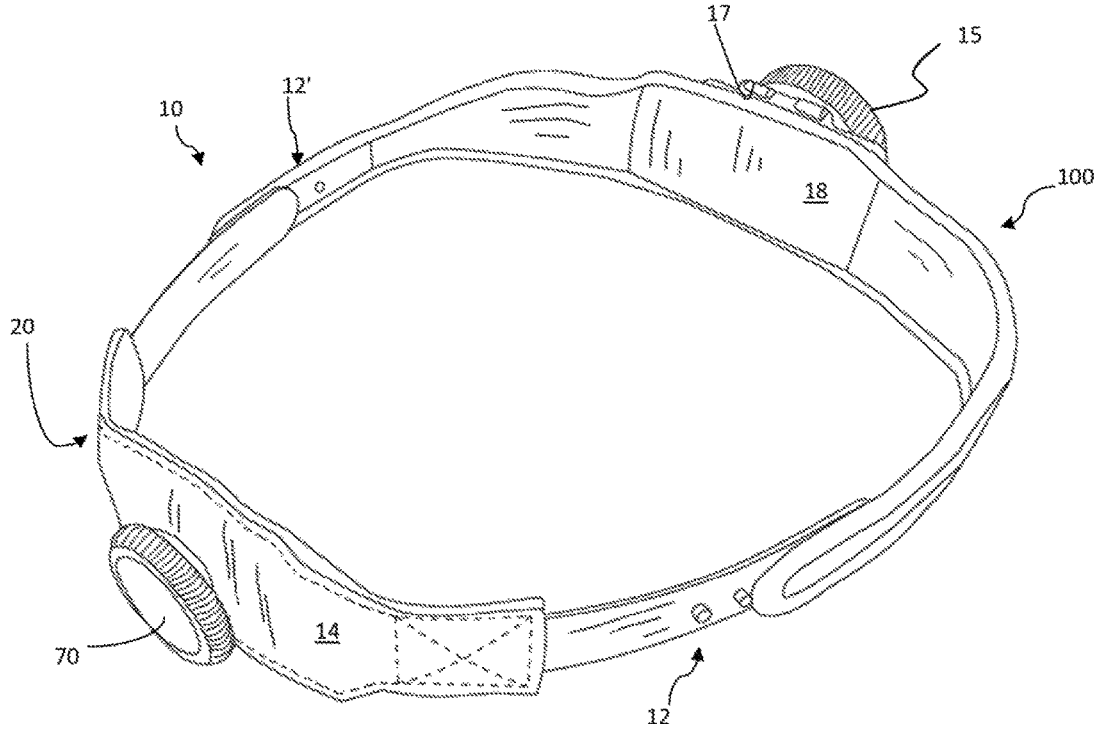
FIG. 1*b* shows a bottom perspective view of the headgear assembly shown in FIG. 1*a*.

FIGS. 1*a* and 1*b* illustrate an exemplary headgear assembly 10 comprising a plurality of components that, in combination, provide an adjustable circumference band having independently adjustable macro and fine fit adjustment systems. The adjustable circumference band, as illustrated, comprises an adjustable band component 20 (partially enclosed in an external flexible cover, or comfort cover 13, 14, in FIGS. 1*a* and 1*b*) illustrated in FIG. 2 (with components illustrated, in detail, in FIGS. 3*a*-3*h*) and a flexible accessory mount band 100 (partially enclosed in an external flexible cover, or internal comfort cover 18 and external cover 19, in FIGS. 1*a* and 1*b*), illustrated in FIGS. 4*a*-4*c* (with components and features illustrated, in detail, in FIGS. 5-9). The adjustable band component 20 and flexible accessory mount band 100 are detachable from and connectable to one another at macro fit adjustment regions 12, 12'. Fine circumferential fit may be provided by a pawl gear and ratchet system mounted internally of internal and external comfort covers 13, 14, respectively, and operated by rotation of fine adjustment knob 70. Accessory 15 (e.g., a lamp) is mounted to housing 16, with a hinge 17, which interfaces with an accessory mount framework mounted internally of internal comfort cover 18 and external cover 19.

Figure 2:
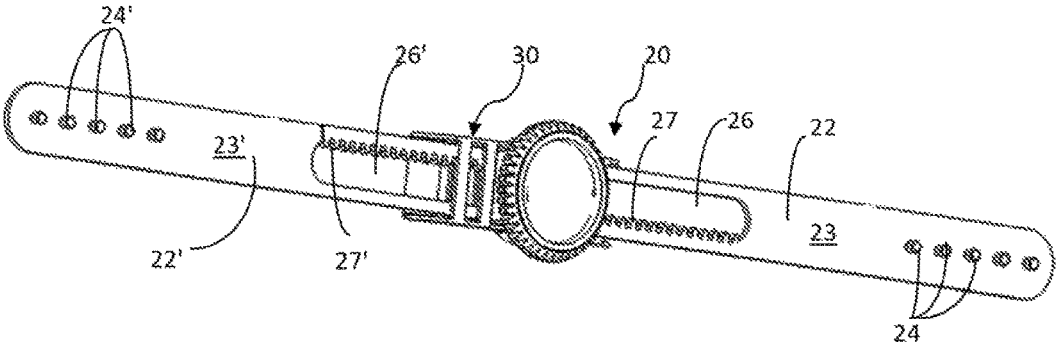
FIG. 2 shows an external perspective view of one embodiment of an adjustable band component providing two independently adjustable fit features.
Figure 3A:
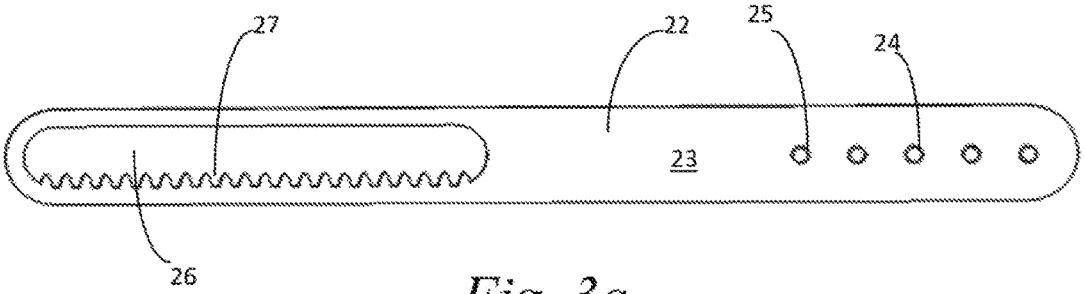
FIG. 3*a* shows a front elevation view of one embodiment of a length adjustment strap incorporated in the adjustable band component illustrated in FIG. 2.
Figure 3B:
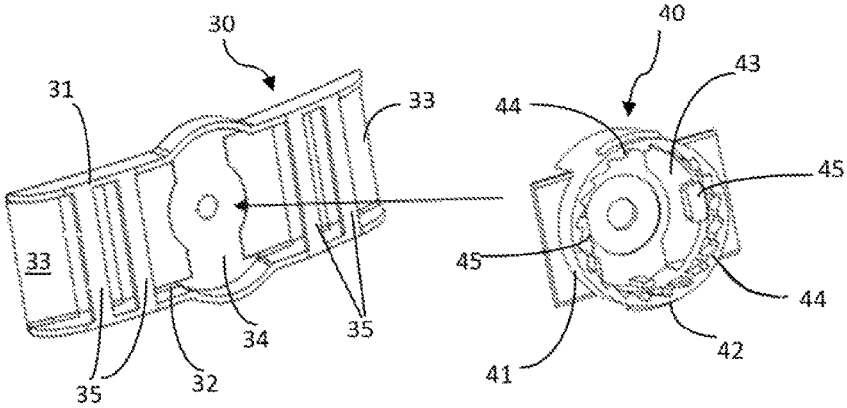
FIG. 3*b* shows a view of one embodiment of a strap alignment component and a fine adjustment housing forming part of the adjustable band component illustrated in FIG. 2.
Figure 3C:
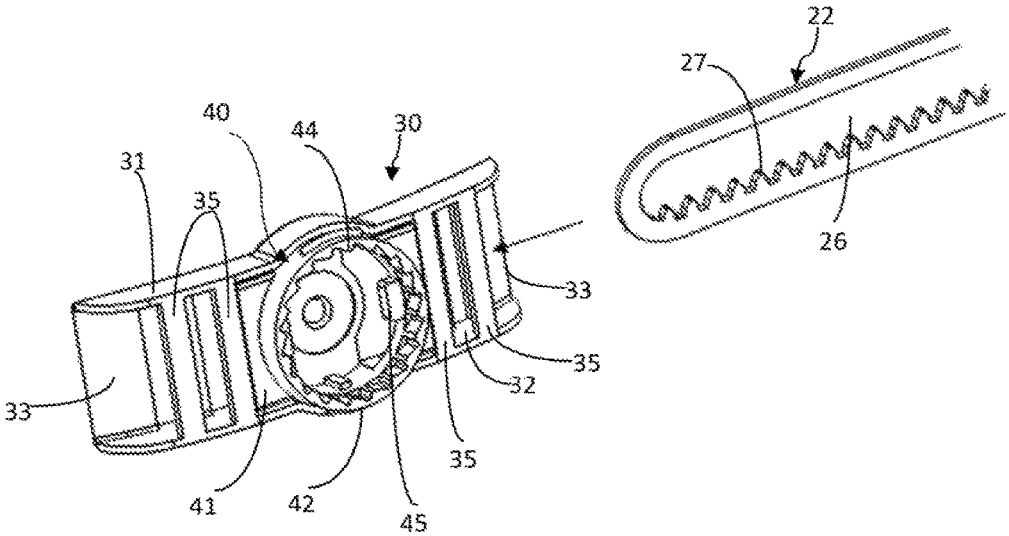
FIG. 3*c* shows a perspective view of one embodiment of a strap alignment component and fine adjustment housing receiving a length adjustment strap forming part of the adjustable band component illustrated in FIG. 2.
Figure 3D:
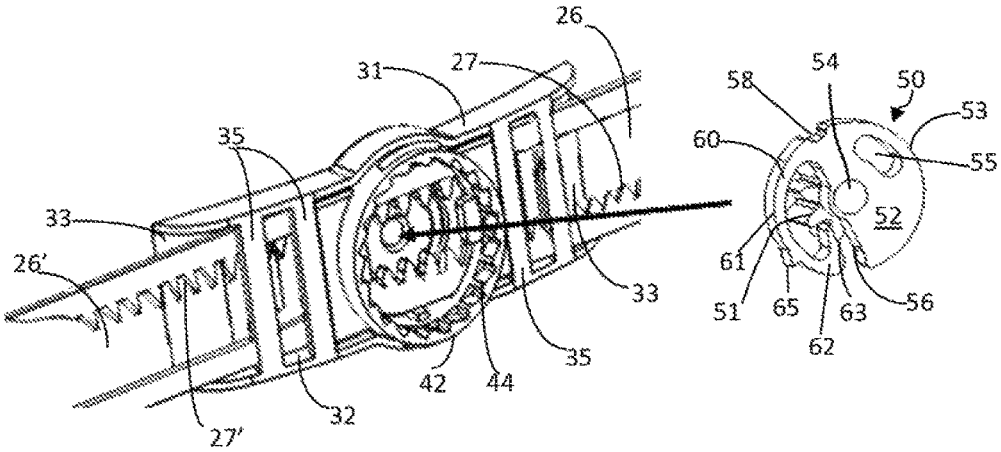
FIG. 3*d* shows a perspective view of a pair of length adjustment straps mounted through a strap alignment component having a fine adjustment housing receiving a locking pawl and pawl gear forming part of the adjustable band component illustrated in FIG. 2.
Figure 3E:
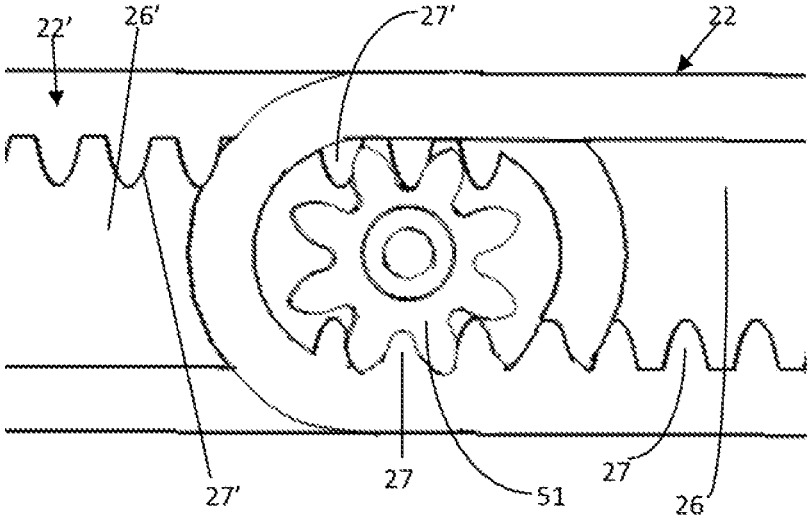
FIG. 3*e* illustrates an enlarged front elevation view of gear teeth of the pawl gear interfacing with complementary teeth of opposing length adjustment straps.
Figure 3F:
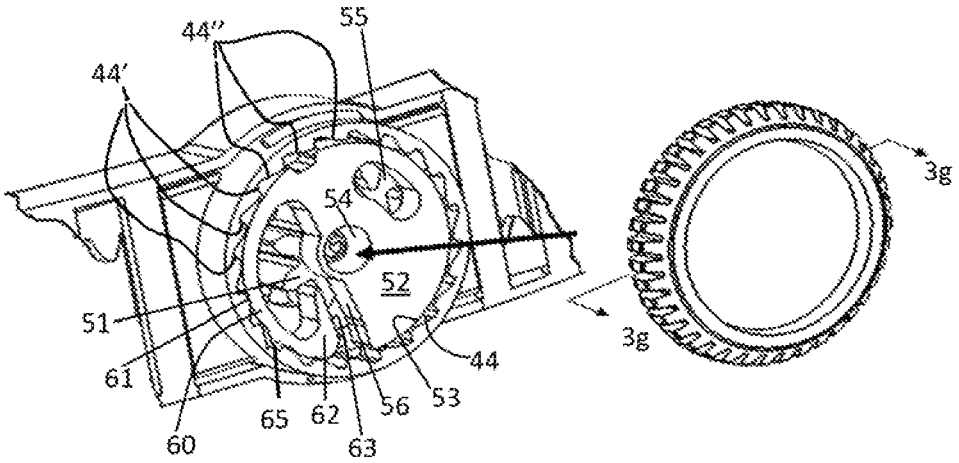
FIG. 3*f* shows an enlarged perspective assembled view of the fine adjustment assembly components illustrated in FIGS. 3*a*-3*e*, forming part of the adjustable band component illustrated in FIG. 2, with the rotational dial removed.
Figure 3G:
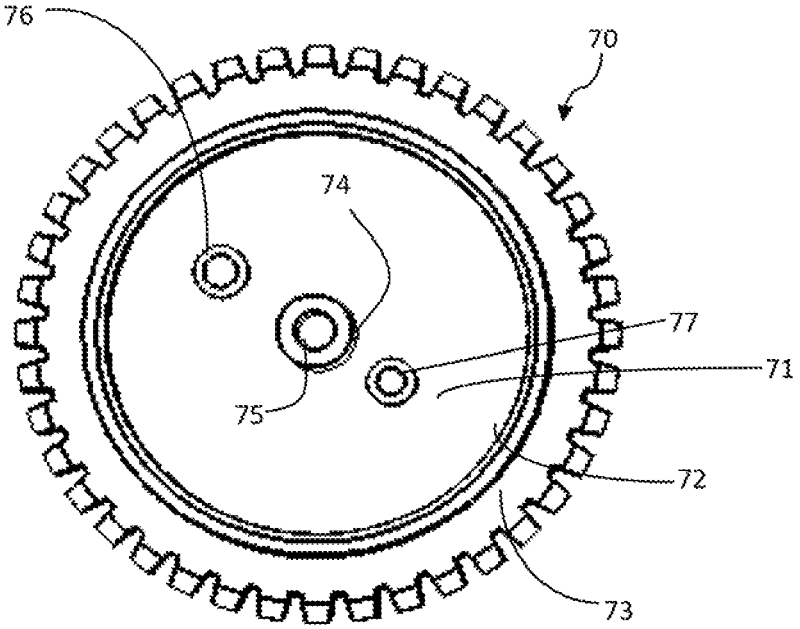
FIG. 3*g* illustrates an enlarged rear elevational view of the rotating dial of FIG. 3*f*, configured for mounting to and rotating the pawl gear and locking pawl of the fine adjustment assembly.
Figure 3H:
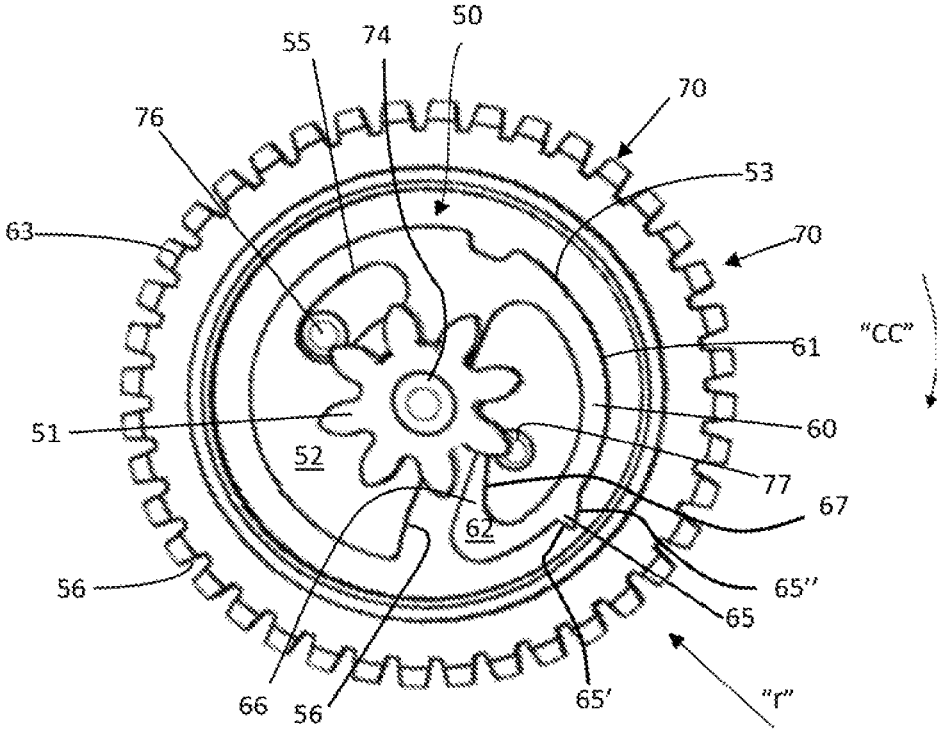
FIG. 3*h* illustrates an enlarged plan view of the locking pawl of FIG. 3*f* positioned in an internal cavity of the rotating dial, forming part of the fine adjustment mechanism.

The adjustable band component 20 illustrated in FIG. 2 (with coverings 13, 14 removed) comprises a pair of length adjustment straps 22, 22' (strap 22 illustrated in FIG. 3*a*), a strap alignment component 30 and fine adjustment housing 40 (illustrated in FIGS. 3*b*-3*d*), a locking pawl component 50 (illustrated in FIGS. 3*d*, 3*f* and 3*h*) and a fine adjustment knob 70 (illustrated in FIGS. 3*g* and 3*h*). Detailed descriptions of specific embodiments of each of these components are provided below, with reference to the drawings.

In some embodiments, length adjustment strap(s) 22, 22' have a generally linear orientation with a generally smooth internal surface and macro adjustment features such as a plurality of bosses 24, 24' protruding at one end region from an external surface 23, 23'. Bosses 24, 24' may form generally cylindrical protrusions, as shown, and may have an enlarged external region 25, illustrated schematically in FIG. 3*a*, or may be undercut internally of an enlarged external region providing a secure press fit with mating cavities in a complementary circumferential band assembly, such as flexible accessory mount band 100. Fitting of one or more bosses 24 in mating cavities of a complementary circumferential band assembly provides a macro circumferential adjustment feature. While the bosses 24, 24' are illustrated having uniform, symmetrical spacing and are positioned generally along a midline of external surface 23, bosses or other mating features may be provided having an asymmetrical spacing or alignment or may be positioned asymmetrically on length adjustment strap 22, 22'.

In some embodiments, at least two bosses 24 are spaced from one another at length adjustment increments of from 5-10 mm. In some embodiments, from 3 to 6 bosses are provided on each length adjustment strap, providing macro adjustment of from 15-60 mm on each length adjustment strap, providing a total macro adjustment length of from about 30-120 mm. In some embodiments, the number and spacing of bosses is arranged to provide a total macro adjustment length of from about 80-150 mm. In some embodiments, the strap positions corresponding to bosses and/or mating receiving holes may be labeled with predetermined size or fit designations—e.g., XS, S, M, XL, XXL, etc., guiding a user to quickly identify appropriate macro size adjustments. It will be appreciated that while bosses are described and shown on length adjustment straps and receiving bores are described and shown located on a complementary circumferential band assembly, the locations of these fittings may be reversed.

Referring to, for example, FIG. 3*a*, the other end region of each of length adjustment strap 22 has a slot 26 extending linearly and, in the embodiments illustrated, aligned on a longitudinal axis that corresponds to the longitudinal axis of the length adjustment strap. Slot 26 may have an elongated and generally oblong configuration, as shown. A series of teeth 27 may be provided along one of the longitudinal edges of slot 26, extending toward a central region of the slot, as shown in FIGS. 2 and 3*a*. Two length adjustment straps 22, 22' are aligned in opposite (e.g., internal surface to external surface) orientations during assembly of an adjustable band component, so that teeth 27, 27' extend from opposite longitudinal edges of slots 26, 26' as shown in FIG. 2.

Teeth 27 are used in the fine adjustment mechanism and are generally configured and spaced in a regular, uniform pattern and are sized and configured to interface and mesh with an internal pawl gear (described below). The alignment of teeth 27, 27' on opposite cavity edges of length adjustment straps 22, 22' when the adjustable band component is assembled provides engagement of teeth on each strap and displacement of each of the straps relative to the other when the internal pawl gear is rotated. The space between teeth (center to center) is generally between about 0.5 to 3 mm, and often about 1 mm, and in some embodiments, at least 10 teeth may be provided. In some embodiments, from about 10 to 30 teeth are provided on each length adjustment strap; in other embodiments from 15 to 25 teeth, or more or less teeth, may be provided on each length adjustment strap.

FIG. 3*b* illustrates strap alignment component 30 having opposing top and bottom walls 31, 32 and at least one internal strap guide 33 extending between internal regions of top and bottom walls 31, 32 on opposite sides of a central mount region 34 and, in combination with mount region 34, forming an internal component surface. In some embodiments, the internal component surface has a curved configuration adapted to rest comfortably against a user's head or another structure encompassed by the circumferential band assembly. The width (measured from internal to external edge) of top and bottom walls 31, 32 can be generally from about 3×-10× the thickness of length adjustment strap 22.

In some embodiments, at least one external strap guide 35 extends between external regions of top and bottom walls 31, 32 on each side of central mount region 34. The size and configuration of the strap alignment component, and the arrangement of the internal and external strap guides, is arranged and adapted to receive a pair of length adjustment straps 22, 22' overlapping and inserted in opposed orientations, permitting displacement (sliding) of opposed length adjustment straps in relation to one another.

In some embodiments, fine adjustment housing 40 is mounted to strap alignment component 30 at an external location, as schematically illustrated in FIGS. 3*b*-3*d*. Fine adjustment housing 40, as illustrated, comprises a mounting base 41 sized and configured to be received between external strap guides 35 of strap alignment component 30. Fine adjustment housing 40, as shown, has a circular outer rim 42 and an internal cavity 43. In some embodiments, saw-tooth serrations 44 are provided on an interior surface of outer rim 42, directed inwardly toward internal cavity 43. The saw-tooth serrations 44 interface with features on a locking pawl component (described below) to provide a fine adjustment ratcheting lock mechanism.

Referring to the example embodiment shown in FIG. 3*c*, shoulder 45 which extends radially inward relative to outer rim 42, can help block an end of strap 22' from shifting in an external direction (out of its intended plane of movement), and thereafter being prevented from sliding in the tightening direction. For example, when an end of strap 22' is within the housing 40, it could shift externally (misalignment), and be blocked from tightening. The shoulder 45 can help keep the strap 22' aligned for movement through the housing 40 during tightening, by blocked external movement out of the plane. A diametrically opposed shoulder to the shoulder 45, can also be provided to prevent an end of strap 22 from shifting in an external direction.

Referring to FIGS. 3*c* and 3*d*, in some embodiments, fine adjustment housing 40 is positioned at a central, external region of alignment component 30. FIG. 3*c* schematically shows length adjustment strap 22 being guided between internal and external strap guides of strap alignment component 30. FIG. 3*d* shows complementary length adjustment straps 22, 22' mounted between internal and external strap guides and passing behind a portion of fine adjustment housing 40. FIG. 3*e* shows an enlarged view of the pair of length adjustment straps 22, 22', aligned in overlapping and opposite orientations, with teeth 27, 27' of each length adjustment strap engaged by a pawl gear 51. When the gear 52 is rotated clockwise (in the arrangement shown in FIGS. 3*d* & 3*e*) by manual rotation of the knob 70 in clockwise direction, the overall length of the strap combination is reduced; when the gear is rotated counterclockwise by manual rotation of the knob 70 in counterclockwise direction, the overall length of the strap combination is increased, until the gear is positioned at the end of each slot.

FIG. 3*d* additionally illustrates a locking pawl component 50 that is mounted within fine adjustment housing 40, as shown in FIG. 3*f*. Locking pawl component 50 includes an internal pawl gear 51 (discussed supra) having a length (depth) sufficient to extend through internal cavity 43 within rim 42 of fine adjustment housing 40 to engage teeth 27, 27' of each of the length adjustment straps. Locking pawl component 50, as illustrated, also includes a body portion 52 having a curved outer edge 53 sized and configured to fit within the rim 42 of fine adjustment housing 40. A central mounting bore 54 penetrates body portion 52 and internal gear 51, and pin receipt slot 55 is also provided in body portion 52 of locking pawl component 50. Flexible pawl arm 60 extends from and may be formed integrally with body portion 52 and also has a curved outer edge 61 sized and configured to fit within fine adjustment housing 40.

In some embodiments, curved outer edge 61 of flexible pawl arm 60 extends from and may be continuous with curved outer edge 53 of body portion 52 and terminates at a hook-like end 62 having an end wall 63 that is separated a distance from a neighboring end wall 56 of body portion 52. Pawl arm 60 is sufficiently flexible to permit movement of hook-like end 62 and end wall 63 toward and away from neighboring wall 56 of body portion 52.

In some embodiments, protrusion 65 is formed and located on curved outer edge 61 of flexible pawl arm 60 and is sized and configured to interface with saw tooth serrations 44 located along the interior surface of fine adjustment housing 40. As locking pawl 50 and flexible pawl arm 60 are rotated in one direction (e.g., clockwise as shown in FIGS. 3*d* and 3*f*), protrusion 65 is received in successive saw tooth serrations located around the circumference of the fine adjustment housing and movement of protrusion 65 and flexible pawl arm 60 tracks along the saw tooth serrations. In the illustrated embodiments, locking pawl additionally includes a notch 58.

Referring to FIG. 3*b*, in some embodiments, rotational adjustment knob or dial 70 mounts to an external side of the fine adjustment housing and encloses the fine adjustment mechanisms. Rotational adjustment knob 70, as illustrated, provides an internal cavity 71 bordered by rim 72 and an external user interface dial 73 that may be provided with a knurled or raised rib user interface surface, or may have other surface features or configurations that enhance a user's grip and ability to rotate the adjustment knob in either direction. Internal cavity 71 is sized and configured for receiving the locking pawl 50, as shown in FIG. 3*h*. In some embodiments, alignment pin 74 extends from an internal surface of the rotational adjustment knob and has a length sufficient to transit the locking pawl 50 and its internal gear 51. Locking pawl 50 may be mounted on alignment pin 74 to provide rotation of locking pawl 50 about alignment pin 74. In some embodiments, mounting pin 74 may have an internally threaded bore 75 or carry an internally threaded insert for receiving a fastener, such as a screw, to align rotational knob 70 and locking pawl 50 within fine adjustment housing 40 and secure it to strap alignment component 30.

An internal surface of rotational adjustment knob 70 may also comprise two pawl interface pins 76, 77 projecting a distance less than that of mounting pin 74. The locking pawl 50 is mounted and positioned such that pawl interface pin 76 is received within pin receipt slot 55 and pawl interface pin 77 is positioned near a tip 66 of hook-like end 62 of flexible pawl arm 60.

In some embodiments, the locking pawl component 50 is flexibly, or pivotably attached to the adjustment knob 70 via the alignment pin 74. That is, when a user manually rotates the knob 70 in counterclockwise rotation (e.g., arrow "CC" in FIG. 3*h* refers to the direction of counterclockwise rotation as viewed from an external side of the knob 70), the knob can initially twist or pivot about an axis of the alignment pin 74 relative to the locking pawl component 50, with the locking pawl component initially met by resistance caused, at least in part, by an interfering face 65' of the protrusion 65, abutting against interfering faces 44' (see, e.g., FIG. 3*f*) of the saw-tooth serrations 44. That is, for example, the interfering faces 65', 44' can be substantially radially extending faces, as opposed to sloped faces 44", 65". However, as best seen in FIG. 3*h*, as pin 77 on the knob travels counter clockwise toward stationary hook-like end 62 of flexible/elastic pawl arm 60 (temporarily stationary due to interference between interfering faces 44', 65') to abut against inner surface 67 thereof, the pawl arm 60 is pulled radially inward to cause the protrusion 65 to move radially inward (see, e.g., arrow "r") to temporarily relieve interference between the interfering faces 44', 65'. Thereafter, the entire locking pawl component 50, including the pawl gear 51, is caused to rotate counterclockwise by rotation of the knob 70, without interference of the interference faces 44', 65', until the protrusion 65 comes to rest within a valley between a successive set of saw-tooth serrations, whereupon the same mechanism can be repeated to relieve the interfering faces 44', 65', as the knob is rotated in counterclockwise direction, and so on. As will be appreciated by those skilled in the art after reviewing this disclosure, this mechanism as described provides a default lock against counterclockwise (or loosening) rotation of the gear 51, unless the knob 70 is manually turned in a counterclockwise rotation.

In some embodiments, rotation of the locking pawl component 50 relative to the rotational knob 70 in a clockwise direction is constrained by interference of pawl interface pin 76 located in pin receipt slot 55. Conversely, as the knob is rotated in the counterclockwise direction, forcing the hook-like portion 62 of the pawl arm 60 to contact the neighboring end wall 56 of body portion 52 as the pawl component 50 is temporarily stationary (due to interface faces 44', 65'), pawl interface pin 76 travels to the opposite side of the slot 55 to be constrained thereby as well.

In some embodiments, the adjustable band components are typically fabricated from plastic(s), and may be provided as injection molded plastic components. Length adjustment straps are generally fabricated from a flexible, bendable plastic material and may be provided as molded plastic components. Plastics such as thermoplastics, thermoplastic polyurethanes, and the like, having a durometer of from about 40 D-70 D on a Shore scale are suitable. Higher stiffness plastics such as Polyoxymethylene (POM) are suitable for constructing the strap alignment component, the fine adjustment housing, and the locking pawl. The rotational dial or knob may be fabricated from high stiffness plastics such as POM, nylons, glass-filled nylons, or the like.

A cover component, shown in FIGS. 1*a* and 1*b*, may be stitched or otherwise mounted over the internal and/or external surfaces of the fine adjustment system, and wholly or partially cover internal and/or external surfaces of the length adjustment straps. In the embodiment illustrated in FIGS. 1*a* and 1*b*, an internal comfort cover 13 is provided substantially covering internal surfaces of the fine adjustment mechanism and portions of the length adjustment straps extending from the fine adjustment mechanism. Internal comfort cover 13 may be fabricated from a material that cushions the interface with a user's head. Suitable materials include synthetic or natural fabrics, synthetic rubber and/or foam compositions, such as Neoprene/SBR/Foam, and the like. The external surface of the fine adjustment mechanism and portions of the length adjustment straps may be covered, partially or completely, with an external facing cover 14 to conceal the adjustment mechanism and provide a more desirable aesthetic appearance. External facing cover 14 may be fabricated from a material such as a fabric, natural or synthetic leather, rubber, fleece, or the like. Internal comfort cover 13 and external facing cover 14 may be stitched to one another along interface regions, or may be otherwise attached to one another, or to underlying components of the adjustment mechanism.

To adjust an adjustable circumference headgear strap assembly for the first time, a user can position and detachably mount interfacing features of a macro adjustment system to fit the general size of his or her head. Following the macro adjustment, the strap assembly should generally fit on a user's head, but it may be slightly too loose or slightly too tight for comfort. The fine adjustment dial and mechanism is then used to fine tune the length of the strap, providing a highly customized fit. To operate the fine adjustment feature, the rotational dial 73 of the knob 70 on the back portion of the strap is rotated clockwise or counterclockwise to tighten or loosen the strap (or vice versa) in small increments. Throughout use, as conditions change, as users change, or fit conditions change, the strap fit system can be adjusted, slightly and at any desired frequency, in a convenient manner to provide a better fit and more comfort.

Figure 4A:
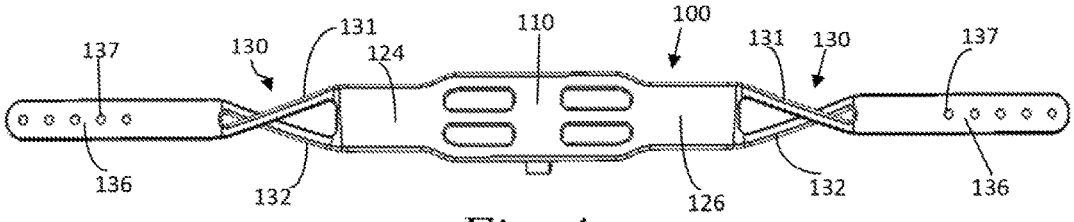
FIG. 4*a* illustrates a rear (e.g., facing a user's head) elevation plan view of one embodiment of a flexible accessory mount band.
Figure 4B:
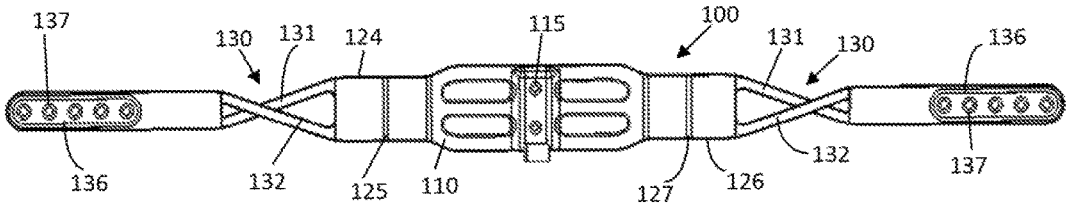
FIG. 4*b* illustrates a front elevation view of the flexible accessory mount band shown in FIG. 4*a*.
Figure 4C:
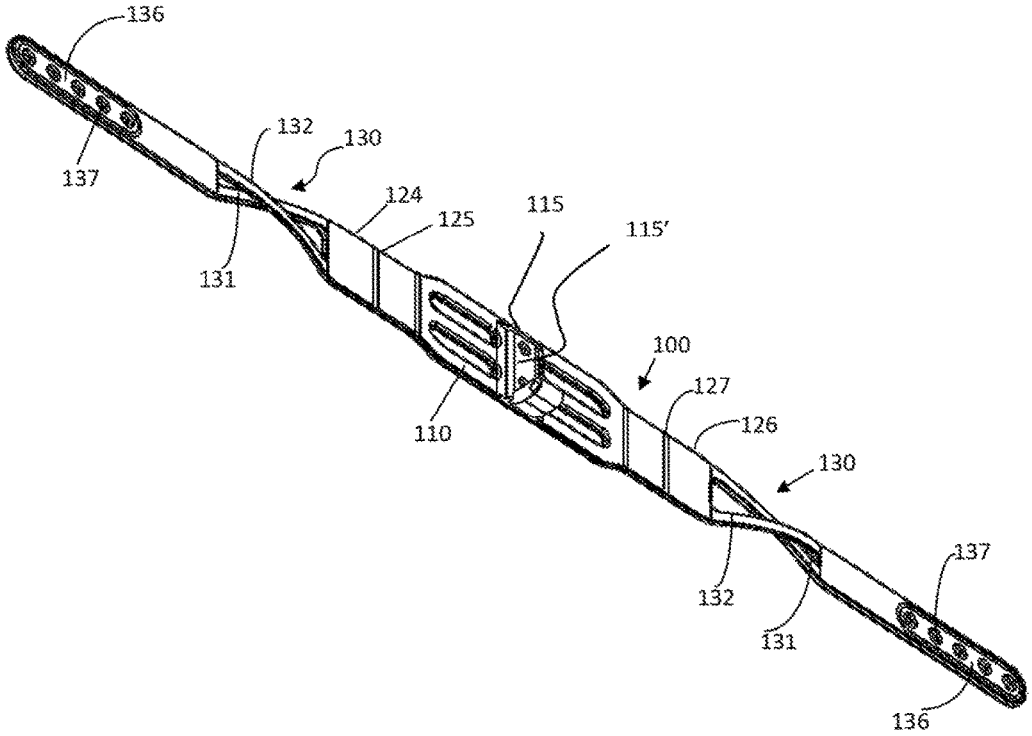
FIG. 4*c* illustrates a perspective view of the internal surface of the flexible accessory mount band shown in FIG. 4*a*, clearly showing a pivot arm projecting externally of an accessory mount component.

In some embodiments, headgear assemblies as described herein additionally comprise a flexible accessory mount band 100, illustrated in FIGS. 4*a*-4*c* (with components and features illustrated, in detail, in FIGS. 5*a*-9). Frame accessory mount assembly 100 comprises an accessory frame 110 supporting an accessory mount 115, with vertically extending section 115', at its external surface and having flexible straps with macro adjustment interface features extending from opposite sides of accessory frame 110. The macro adjustment features (e.g., bosses or recesses) mate with complementary adjustment features on the length adjustment straps (described above), providing detachable mounting of the frame accessory mount assembly to the adjustable band component.

Figure 5:
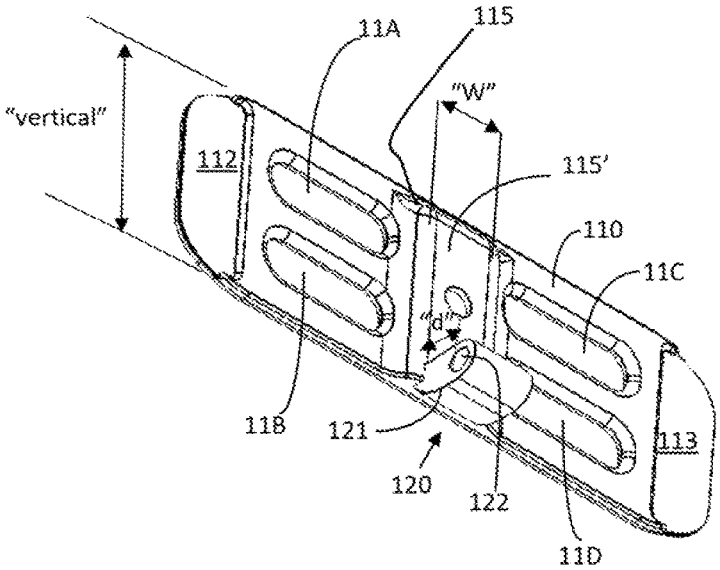
FIG. 5 shows an enlarged perspective view of an external surface of one embodiment of an accessory mount framework including a hinge component as disclosed herein.

FIG. 5 illustrates an enlarged view of one embodiment of an accessory frame 110, an associated accessory mount 115 and an associated hinge mount 120. In the embodiment illustrated, accessory frame 110 may be fabricated from a flexible material such as a flexible thermoplastic polyurethane (TPU). The material may have a hardness of from about 40 D-80 D on the Shore scale. Materials such as Elastolan TPU 1154D can be suitable. Accessory frame 110, as shown, may include one or more cavities, illustrated as elongated cavities 111A-D to provide additional flexibility, enhanced conformity to underlying surfaces (e.g., the head of a user), and/or to reduce the weight of accessory frame 110. While accessory frame 110 is illustrated having a generally rectangular configuration, it will be appreciated that accessory frame components may comprise many different configurations and sizes.

Accessory frame 110 has a generally low thickness and, in some embodiments, has a thickness equal to or less than about 2 mm; in some embodiments the maximum thickness of accessory frame is between about 2 and 4 mm. References to the thickness of the accessory frame comprehend the accessory frame only and do not include any accessory mount which may be associated with an accessory frame. In some embodiments, the thickness of accessory frame 110 may vary over its surface area, and thinner areas may be provided in regions 112, 113 more distant from an accessory mount location. These thinner areas are not provided in some embodiments. For example, in some embodiments where the accessory frame 110 is formed integrally as part of an accessory band, the thinner end regions 112, 113 can be omitted. In some, but not all embodiments of the accessory band 100, the accessory frame is integrally formed without thinner end regions 112,113. In some embodiments, the thinner regions 112, 113 can be provided on an accessory frame 110, and can be used to stitch end portions of strap sections of a head strap assembly to the accessory frame 110 at the thinner end areas 112, 113, using threads, in any of a variety of manners, as will be appreciated by those skilled in the art after reviewing this disclosure. In this manner, the frame 110 can be easily connected to a strap assembly that a user can attach to a user's head.

In various embodiments, including that shown in FIGS. 5 and 4*a*-4*c*, accessory mount 115, shown associated with an external central region of accessory frame 110, may be fabricated from a substantially rigid material that is harder than that of accessory frame 110, such as a hard plastic material or glass-filled plastic. Suitable materials include synthetic polymeric materials such as Acrylonitrile-Butadiene-Styrene (ABS), polyamides such as Nylon compositions, glass-filled nylons, thermoplastic materials such as acetal, polyacetal and polyformaldehyde, resin-based materials and reinforced resin-based materials, and the like. Accessory mount 115 is generally smaller (e.g., narrower) than accessory frame 110 and may be mounted in a central portion of accessory frame 110, as shown in FIGS. 4*a*-4*c*. In some embodiments, the width of accessory mount 115 and hinge mount 120 (shown as "W" in FIG. 5) is less than about 20 mm; in some embodiments the width of accessory mount 115 and hinge mount 118 is less than about 16 mm.

In some embodiments, accessory mount 115 may be permanently or semi-permanently associated with accessory frame 110, such as by permanent attachment fittings or overmolding the harder accessory mount in the softer accessory frame 110. The accessory frame 110 having cavities 11A-11D, being formed of a flexible material softer than that of the accessory mount 115 (and in some embodiments being thinner than the accessory mount 115), can easily bend to conform to the shape of a user's head, and in particular, for example, the lateral side portions on either side of the accessory mount 115 can easily bend in the internal direction, while the accessory frame still provides sufficient support to retain the accessory mount 115 in an upright manner so that a user can control the angle of tilt of the accessory (e.g. headlamp) mounted to the accessory mount 115.

In some embodiments, the accessory mount 115 has a height approximately equal to a height of the accessory frame 110 (as can be seen in FIG. 5), or at least ½ of the height of the accessory frame. In other embodiments, the accessory mount 115 has a height greater than that of the accessory frame. The cavities 11A-11D can be disposed on both lateral sides of the accessory mount 115 on the accessory frame 110.

The accessory mount 115 may have an associated pivot hinge mount 120 extending externally of the accessory mount 115 and accessory frame 110. Pivot hinge mount 120, as illustrated, comprises an arm 121 extending externally from accessory mount 115 and a hinge mount recess/aperture 122 for receiving a hinge pin associated with an accessory or an accessory housing. Pivot arm 121 generally extends for a distance externally of accessory mount 115 sufficient to provide unfettered rotation of an accessory mounted at hinge mount recess 122 through an angular rotation of at least about 45°. In some embodiments, pivot arm 121 extends for a distance from accessory mount 115 sufficient to provide free rotation of an accessory mounted at hinge mount recess 122 through an angular rotation of at least about 60°, in some embodiments through an angular rotation of at least about 90°; in yet other embodiments through an angular rotation of at least about 120°, and in still other embodiments through an angular rotation of at least about 150°. This range of pivoting motion allows the user to direct the accessory (producing, for example, a light beam) in a wide range of directions.

Figure 7:
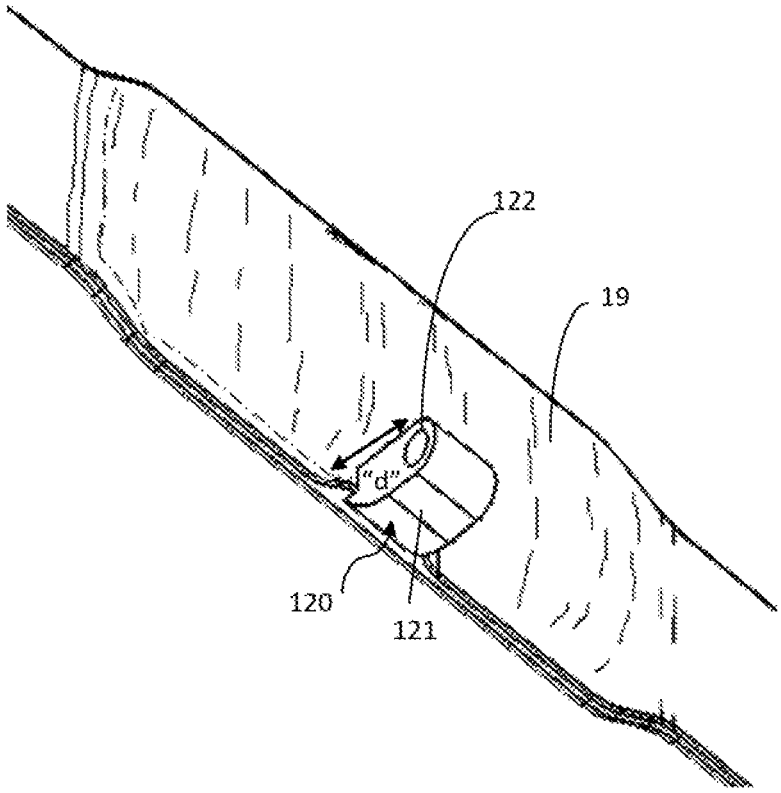
FIG. 7 shows an enlarged perspective view of a cover provided over an accessory mount framework of the type illustrated in FIG. 5 with an externally projecting pivot arm.

In some embodiments, the distance between the interface of pivot arm 121 with accessory mount 115 and a central axis of hinge mount recess, shown as "d" in FIG. 7, is at least 3 mm; in some embodiments, the distance between the interface of pivot arm 121 with accessory mount 115 and a central axis of hinge mount recess is at least 5 mm; in other embodiments, the distance between the interface of pivot arm 121 with accessory mount 115 and a central axis of hinge mount recess is at least 6 mm. In some embodiments, pivot arm 121 extends externally of accessory frame 110 at a substantially right angle. In some embodiments, pivot arm 121 extends externally of accessory frame 110 at an angle of from about 45° to 135°.

The frame assembly mount assembly 110, as illustrated in FIGS. 4*a*-4*c*, additionally comprises flexible band portions 124, 126 located laterally on each side of accessory frame 110, and optionally formed integrally as extensions of accessory frame 110. Flexible band portions 124, 126 may be scored at one or more locations, such as at grooves 125, 127, respectively, to provide enhanced bending and conformation to an underlying surface. In alternative embodiments, flexible band portions may be perforated or scored using different patterns to provide enhanced flexibility. Flexible band portions 124, 126 may moreover have a narrower profile than that of accessory frame 110, as illustrated in FIGS. 4*a*-4*c*.

Figure 6:
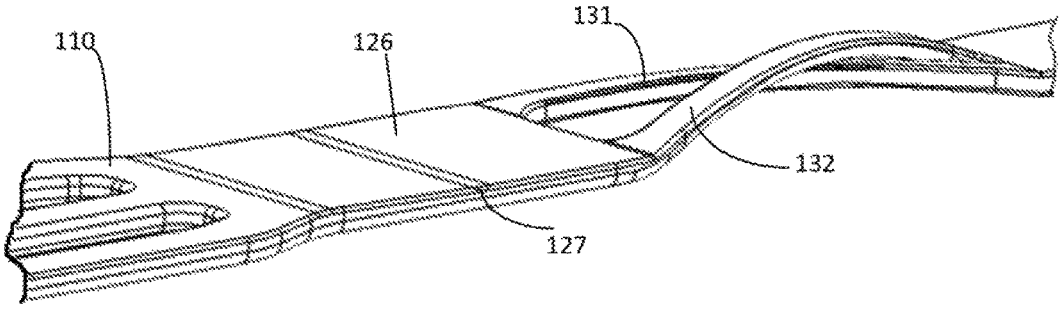
FIG. 6 illustrates an enlarged perspective view of one embodiment of a three-dimensional strap relief feature of a flexible accessory mount band.

In some embodiments, additional bend and/or rotational relief features may optionally be provided, for example, in the form of criss-crossing or X-configuration leg structures, shown in FIGS. 4*a*-4*c* and 6. In one embodiment, as illustrated, relief features 130 are located laterally of accessory frame 110, between the accessory frame and strap ends 136. In some embodiments, relief features 130 are provided at locations corresponding proximate to a user's temples when the headgear is worn by a user. Relief feature 130, as illustrated, comprises crossed leg members 131, 132 extending laterally from accessory frame 130 or an associated flexible band portion, and joining strap ends 136. Leg members 131, 132 have a relatively narrow profile and are arranged in an overlapping, criss-crossing, X-configuration. In some embodiments, such as shown in FIG. 6, at least one of the leg members 132 may be formed in a curved configuration, extending out of the plane of the other conformable band components. In some embodiments, both leg members may be formed in a curved configuration, and both leg members may extend out of the plane of the other conformable band components. This X-configuration of overlapping leg members allows strap rotation without binding and provides additional flexibility and comfort.

Strap ends 136 having macro adjustment features (e.g., bosses or recesses) that mate with complementary adjustment features on the length adjustment straps, provide detachable mounting of the frame accessory mount assembly to the adjustable band component. In the embodiments illustrated in FIGS. 4*a*-4*c*, strap ends 136 comprise a plurality of aligned boss receiving cavities 137 having a size and configuration that mate with bosses provided on a complementary circumferential strap fit system.

The dimensions (e.g., width) of conformable frame accessory mount assemblies, as described herein, may taper from wider to narrower in the direction from central to lateral regions, as shown in the embodiments illustrated in FIGS. 4*a*-4*c*. In some embodiments, the accessory frame 110 may have a first width; flexible band portions 124, 126 located laterally of the accessory frame may have a second width, narrower than the first width; and strap ends 136, located laterally of the accessory frame and relief features may have a third width, narrower than the first and second widths.

In some embodiments, the conformable accessory mount band components are fabricated from plastic(s). The conformable accessory mount band, as described, may be provided as multiple pieces joined to one another, or may be provided as a single band, fabricated as an injection molded plastic component, optionally with the accessory mount comprising a different material. In some embodiments, an accessory mount band may be fabricated from flexible, moldable thermoplastics such as thermoplastic polyurethanes, and the like, having a durometer of from about 40 D-40 D on a Shore scale are suitable. Higher stiffness plastics such as Polyoxymethylene (POM), ABS, Nylons, glass-filled Nylons, and the like, are suitable for constructing the accessory mount and pivot hinge mount.

Cover components, shown in FIGS. 1*a* and 1*b*, may be stitched or otherwise mounted over the internal and/or external surfaces of the conformable accessory mount band components and features, and wholly or partially cover internal and/or external surfaces of the accessory mount band components. In the embodiment illustrated in FIGS. 1*a*, 1*b* and 7, an internal comfort cover 18 may be provided substantially covering internal surfaces of the accessory mount structure, with pivot hinge mount 120 projecting from the mount structure and the external cover 19. Internal comfort cover 18 may additionally extend to cover portions of the conformable accessory mount band extending laterally from the accessory mount structure. Internal comfort cover 18 may be fabricated from a material that is soft and cushions the interface with a user's head. Suitable materials include synthetic or natural fabrics, synthetic rubber and/or foam compositions, such as Neoprene/SBR/Foam.

External surfaces of the accessory mount structure and portions of the length adjustment straps may be covered, partially or completely, with an external facing 19 to conceal the mount mechanism and all or portions of the conformable accessory mount band to provide a more desirable aesthetic. External facing 19 may be fabricated from materials such as (woven or non-woven) fabrics, natural or synthetic leather, rubber and rubber-like materials, fleece, or the like. In some embodiments, different types of facing material may be provided along the length of the conformable accessory mount band. In one embodiment, for example, an external facing comprising a mesh-like material or screen may be provided at X-relief relief feature locations.

Figure 8A:
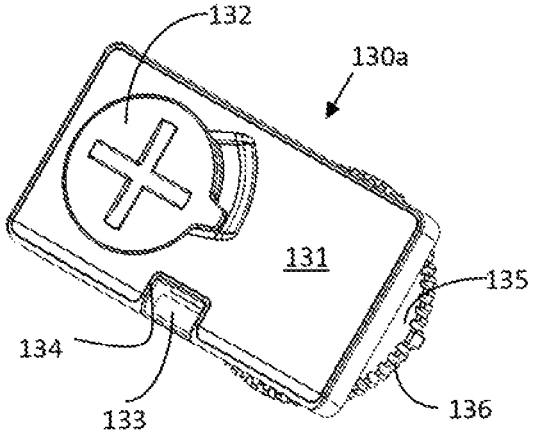
FIG. 8*a* illustrates one embodiment of an accessory for mounting to the accessory mount framework described supra in this disclosure, having a housing that can be accessed by the user and an accessory hinge positioned internally of the housing profile.
Figure 8B:
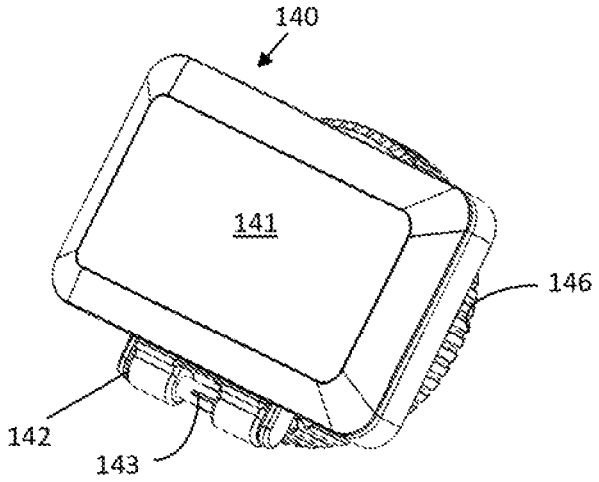
FIG. 8*b* illustrates another embodiment of an accessory for mounting to the accessory mount framework described supra in this disclosure, having an accessory hinge positioned externally of the housing profile.

FIGS. 8*a* and 8*b* illustrate two embodiments of accessories mountable to the accessory mount structure as described herein. In general, accessories comprising a housing for enclosing operating elements such as power sources, electronic control features, etc., and a functional element comprising, for example, a lamp (e.g., a bulb, one or more LEDs, etc.) may be provided. Illumination accessories may implement various illumination features, including uniform lighting, intensity adjustment, intermittent lighting with various frequency light activation, illumination sources or filters providing different wavelength illumination, etc., all of which may be selectable by the user, may be provided. Different types of accessories may also be provided.

FIG. 8*a* illustrates accessory 130*a*, a headlamp, having a housing 131 accessible by means of an opening port cover 132 and having a pivot pin 133 sized and configured to be received within hinge mount recess 122 of a complementary hinge mount associated with an accessory mount. In the embodiment illustrated in FIG. 8*a*, pivot pin 133 is positioned in a housing recess 134 so that, when the accessory housing is pivotally mounted to an accessory mount pivot pin, the pivot mechanism is substantially recessed within the housing framework. An accessory lamp having a knurled or ribbed rim 136 is associated with an external surface of housing 131.

FIG. 8*b* illustrates another embodiment in which accessory 140, a headlamp, comprises a housing 141 having a pivot mechanism 142 comprising a pivot pin 143 that extends along a pivot axis and is configured to be received within hinge mount recess 122 of a complementary hinge mount associated with an accessory mount. In the embodiment illustrated in FIG. 8*b*, pivot mechanism 142 and pivot pin 143 are positioned externally of housing 141. Accessory 140 additionally comprises a knurled or ribbed rim 146 associated with an accessory (lamp) mounted on an external surface of housing 141.

Figure 9:
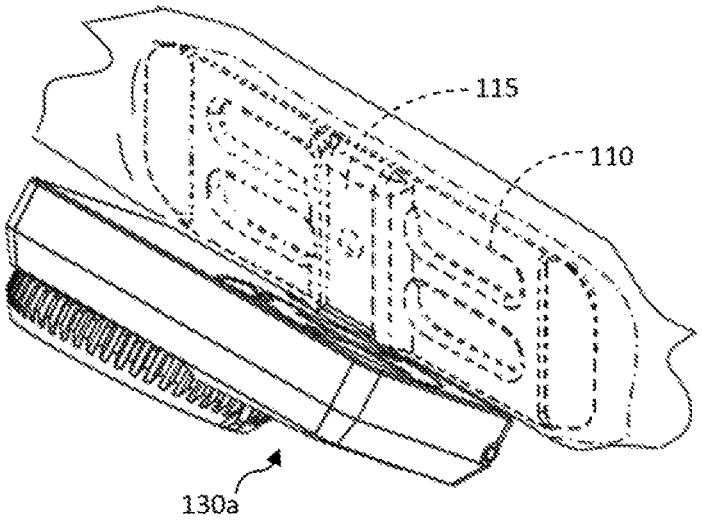
FIG. 9 illustrates an accessory pivotally mounted to a covered accessory mount framework of the type illustrated in FIG. 7, with the internal accessory mount framework illustrated in dashed lines for some embodiments of the present disclosure.

FIG. 9 shows an accessory 130*a* pivotally mounted to an accessory mount structure (shown in dashed lines) including accessory mount 115 and accessory frame 110 enclosed by a cover. Accessory 130*a* is shown pivoted away from the accessory mount structure.

The present disclosure is described with reference to the accompanying drawings in which particular embodiments are shown and explained to provide a thorough understanding of various embodiments of the disclosure. In some instances, well-known mechanical principles and features may not have been described in detail to avoid unnecessary verbage. It is to be understood, however, that upon reviewing this disclosure, persons skilled in the art may modify the embodiments described herein, include additional features, and/or exclude described features, without departing from the spirit and broad scope of the disclosure. Accordingly, the descriptions provided above are considered as being illustrative and exemplary of specific structures, aspects and features within the broad scope of the present disclosure and not as limiting the scope of the disclosure.

Various specific embodiments of the present disclosure are described in the context of headgear and headlamps for illustrative purposes. It will be appreciated that various of the specific components and features described may be implemented, or omitted, in alternative embodiments, and may be combined in different arrangements. It will also be appreciated by those skilled in the art after reviewing this disclosure, that all or selected components, systems and apparatus disclosed herein may have applicability in other contexts, and the disclosures made herein are intended to encompass additional contexts and applications. In some applications, for example, different accessories may be implemented with adjustable strap apparatus; strap apparatus may be applied to other (human or animal) body-mounted applications, such as applications in which apparatus may encircle a user's arm, leg, trunk, torso, neck, or the like. In additional applications, strap apparatus may be adapted for mounting to non-body surfaces, such as non-living objects having round and other configurations.

What is claimed is:

1. An adjustable circumference headgear assembly comprising:

an adjustable band component including a pair of length adjustment straps mounted in an overlapping and sliding relationship, each length adjustment strap having a plurality of first macro adjustment interfaces provided in proximity to an exposed end and a plurality of fine adjustment teeth spaced a distance from the macro adjustment interfaces, the adjustable band component additionally including a fine adjustment mechanism comprising a gear engaging fine adjustment teeth provided on each length adjustment strap, a locking pawl mechanism, and a rotational knob mounted to the gear and locking pawl mechanism providing a user interface for fine adjustment;

a flexible accessory mount band having two end portions, each end portion having a plurality of second macro adjustment interfaces sized and configured for mating with the first macro adjustment interfaces of the length adjustment straps, an accessory frame supporting an accessory mount, and flexible band portions located between the accessory frame and the two end portions;

whereby the adjustable band component and the flexible accessory mount band are detachably attachable to one another by mating first macro adjustment interfaces located at the end of each length adjustment strap with second macro adjustment interfaces provided at each end portion of the flexible accessory mount band;

a cover covering the accessory frame, and an accessory coupled to the accessory mount outside of the cover; and wherein the accessory is pivotally coupled to the accessory mount.

2. The adjustable circumference headgear assembly of claim 1, wherein the accessory is capable of pivoting through an angular rotation of at least about 60° while remaining coupled to the accessory mount.

3. The adjustable circumference headgear assembly of claim 1, wherein the accessory is capable of pivoting through an angular rotation of at least about 120° while remaining coupled to the accessory mount.

4. A headlamp assembly comprising:

a headlamp attached to an accessory mount, the accessory mount being attached to a flexible accessory frame, the accessory mount having a vertically extending section attached to the flexible accessory frame and the accessory mount having a more rigid construction than the flexible accessory frame, with the flexible accessory frame having a cavity formed therethrough disposed on each lateral side of the accessory mount;

an adjustable band component including a pair of length adjustment straps mounted in an overlapping and sliding relationship, each length adjustment strap having a plurality of fine adjustment teeth and additionally including a fine adjustment mechanism having a locking pawl component and a rotational knob, the rotational knob being rotatable in a first direction to engage a gear of the locking pawl component against the fine adjustment teeth to tighten the adjustable band component, and the rotational knob being twistable in a second direction to relative to the locking pawl component to unlock movement of the locking pawl component in the second direction for the gear to rotate in the second direction; and wherein the adjustable band component is attached to the flexible accessory frame by a macro fit adjustment region comprising one or more first interfacing members being detachably coupled to one or more second interfacing members.

5. An adjustable circumference headgear assembly comprising:

an adjustable band component including a pair of length adjustment straps mounted in an overlapping and sliding relationship, each length adjustment strap having a plurality of first macro adjustment interfaces provided in proximity to an exposed end and a plurality of fine adjustment teeth spaced a distance from the macro adjustment interfaces, the adjustable band component additionally including a fine adjustment mechanism comprising a gear engaging fine adjustment teeth provided on each length adjustment strap, a locking pawl mechanism, and a rotational knob mounted to the gear and locking pawl mechanism providing a user interface for fine adjustment;

a flexible accessory mount band having two end portions, each end portion having a plurality of second macro adjustment interfaces sized and configured for mating with the first macro adjustment interfaces of the length adjustment straps, an accessory frame supporting an accessory mount, and flexible band portions located between the accessory frame and the two end portions;

whereby the adjustable band component and the flexible accessory mount band are detachably attachable to one another by mating first macro adjustment interfaces located at the end of each length adjustment strap with second macro adjustment interfaces provided at each end portion of the flexible accessory mount band; and wherein the accessory mount includes a pivot mount having an arm extending externally of the accessory frame and a hinge mount recess provided at an external region of the arm.

6. The adjustable circumference headgear assembly of claim 5, wherein the arm extends externally of the accessory frame at a substantially right angle to a plane of the accessory frame.

7. The adjustable circumference headgear assembly of claim 5, wherein the hinge mount recess is positioned at least about 3 mm externally of the accessory frame.

* * * * *